US009539705B2

(12) United States Patent
Arai et al.

(10) Patent No.: US 9,539,705 B2
(45) Date of Patent: Jan. 10, 2017

(54) BENDING PLIERS

(71) Applicant: HONDA MOTOR CO., LTD., Minato-Ku, Tokyo (JP)

(72) Inventors: Hideki Arai, Tokyo (JP); Hiroyuki Hanada, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 14 days.

(21) Appl. No.: 14/296,687

(22) Filed: Jun. 5, 2014

(65) Prior Publication Data

US 2014/0360244 A1 Dec. 11, 2014

(30) Foreign Application Priority Data

Jun. 7, 2013 (JP) ..... 2013-121041

(51) Int. Cl.
*B25B 7/02* (2006.01)
*B21D 5/00* (2006.01)
(Continued)

(52) U.S. Cl.
CPC ..... *B25B 7/02* (2013.01); *B21D 39/025* (2013.01); *B25B 7/08* (2013.01); *B21D 7/063* (2013.01); *B21D 19/12* (2013.01); *B21D 39/021* (2013.01)

(58) Field of Classification Search
CPC ..... B25B 7/02; B25B 7/04; B25B 7/08; B21D 5/16; B21D 7/06; B21D 7/063; B21D 11/20; B21D 11/203; B21D 19/08; B21D 19/082; B21D 19/088; B21D 19/10; B21D 19/12; B21D 39/02; B21D 39/021; B21D 39/025; B21D 39/026; B21D 51/06
(Continued)

(56) References Cited

U.S. PATENT DOCUMENTS 1,983,519 A * 12/1934 Choate ..... B25B 7/02 72/409.18
3,364,724 A * 1/1968 Schmidt ..... B21D 19/08 72/409.18
(Continued)

FOREIGN PATENT DOCUMENTS

JP 52-157097 U 11/1977
JP S57-108863 U 7/1982
(Continued)

OTHER PUBLICATIONS

Japanese Official Action dated Oct. 15, 2014 issued in the corresponding JP patent application No. 2013-121041.

*Primary Examiner* — Peter DungBa Vo
*Assistant Examiner* — Joshua D Anderson
(74) *Attorney, Agent, or Firm* — Carrier Blackman & Associates, P.C.; Joseph P. Carrier; William D. Blackman

(57) ABSTRACT

Bending pliers include first and second plier bodies connected together relatively turnably in mutually intersecting intermediate portions thereof by a pivot shaft, the bodies including first and second holding arms formed on one-end sides of the bodies, respectively, the arms respectively having plate-shaped first and second claw portions formed in their respective tip end portions and configured to hold a panel to be bent, and first and second handles formed on opposite-end sides of the bodies, respectively, and configured to open and close the arms, wherein a columnar bending fulcrum portion extending parallel to the shaft and projecting toward the second claw portion is formed at a tip end of the first claw portion, and a tip end of the second claw portion faces the fulcrum portion with a gap therebetween. The pliers form the bead portion in a smooth tubular shape in a folded portion of the panel.

6 Claims, 6 Drawing Sheets

(51) Int. Cl.

| | |
|---|---|
| ***B25B 7/08*** | (2006.01) |
| *B21D 39/02* | (2006.01) |
| *B21D 7/06* | (2006.01) |
| *B21D 19/12* | (2006.01) |

(58) Field of Classification Search
USPC ..... 72/319, 409.01, 409.18, 411, 320–323; 29/243.5, 243.57, 243.58; 81/419, 420, 81/424.5, 426, 426.5; 269/6
See application file for complete search history.

(56) References Cited

U.S. PATENT DOCUMENTS

| | | | | | |
|---|---|---|---|---|---|
| 4,014,226 | A * | 3/1977 | Karamarkovich | B25B 7/02 | 81/426 |
| 5,095,732 | A * | 3/1992 | Bootka | B21D 39/021 | 29/243.58 |
| 5,456,144 | A * | 10/1995 | Dahl | B25B 7/02 | 269/6 |
| 6,023,833 | A * | 2/2000 | Jacobsmeier | B25B 31/00 | 29/243.56 |
| 8,028,560 | B2 * | 10/2011 | Badiali | B21D 5/04 | 72/319 |

FOREIGN PATENT DOCUMENTS

| | | | |
|---|---|---|---|
| JP | 58-860 | U | 1/1983 |
| JP | 62-29262 | U | 2/1987 |
| JP | 62-188678 | A | 8/1987 |
| JP | 11-099482 | A | 4/1999 |
| JP | 3064882 | U | 1/2000 |

* cited by examiner

BENDING PLIERS

CROSS REFERENCES TO RELATED APPLICATIONS

The present application claims priority under 35 U.S.C. §119 to Japanese Patent Application No. 2013-121041 filed Jun. 7, 2013 the entire contents of which are hereby incorporated by reference.

BACKGROUND OF THE INVENTION

Field of the Invention

The present invention relates to pliers for use in forming a folded portion at an end edge portion of a panel, in particular, relates to an improvement of bending pliers comprising: first and second plier bodies connected together to be turnable relative to each other in mutually intersecting intermediate portions thereof by use of a pivot shaft, the first and second plier bodies including first and second holding arms formed on one-end sides of the first and second plier bodies, respectively, the first and second holding arms respectively having first and second claw portions formed in their respective tip end portions and configured to hold a panel which is to be bent by hemming and the like, and first and second handles formed on opposite-end sides of the first and second plier bodies, respectively, and configured to open and close the first and second holding arms.

Description of the Related Art

Hemming pliers are known as disclosed in Japanese utility model application laid-open No. 57-108863.

SUMMARY OF THE INVENTION

In the conventional hemming pliers, tip ends of first and second claw portions are designed to be aligned. Accordingly, when a folded portion is formed on a panel using the above-mentioned pliers, the pliers have a disadvantage of causing friction between the panel and the claw portion located on an outer side in a bending direction, and thereby scratching an outer surface in a flexed part of the folded portion of the panel. Also, it is difficult to form a bead portion in a smooth tubular shape in the flexed part of the folded portion by using the pliers.

The present invention has been made in view of the above-mentioned circumstances. An object of the invention is to provide bending pliers capable of forming a bead portion in a smooth tubular shape without scratches in a flexed part of a folded portion of a panel.

In order to achieve the object, according to a first aspect of the present invention, there is provided bending pliers comprising: first and second plier bodies connected together to be turnable relative to each other in mutually intersecting intermediate portions thereof by use of a pivot shaft, the first and second plier bodies including first and second holding arms formed on one-end sides of the first and second plier bodies, respectively, the first and second holding arms respectively having first and second claw portions formed in their respective tip end portions and configured to hold a panel which is to be bent, and first and second handles formed on opposite-end sides of the first and second plier bodies, respectively, and configured to open and close the first and second holding arms, wherein a columnar bending fulcrum portion extending parallel to the pivot shaft and projecting toward the second claw portion is formed at a tip end of the first claw portion, and a tip end of the second claw portion is opposed to the bending fulcrum portion with a gap therebetween.

According to the first aspect of the present invention, in the bending pliers, the columnar bending fulcrum portion extending parallel to the pivot shaft and projecting toward the second claw portion is formed at the tip end of the first claw portion, and the tip end of the second claw portion is opposed to the bending fulcrum portion with the gap therebetween. Thus, a folded portion having a flexed part formed into a tubular bead portion can be formed in the panel by using the bending pliers. In particular, the second claw portion with the tip end opposed to the bending fulcrum portion with an interval does not come into contact with the flexed part of the folded portion of the panel. Thus, the smooth bead portion without scratches can be formed in the flexed part of the folded portion.

According to a second aspect of the present invention, in addition to the first aspect, the first and second holding arms are formed by bending while locating the second holding arm inside, and the first and second handles are formed by bending while locating the first handle inside.

According to the second aspect of the present invention, the first and second holding arms are formed by bending while locating the second holding arm inside, and the first and second handles are formed by bending while locating the first handle inside. Thus, when the inwardly folded portion is formed on the panel of a structure, initial positions of the first and second handles are located outside the structure. As a consequence, when the handles are turned, it is possible to form the folded portion without turning the handles deep into the structure.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention will be described below with reference to the accompanying drawings.

Figure 1:
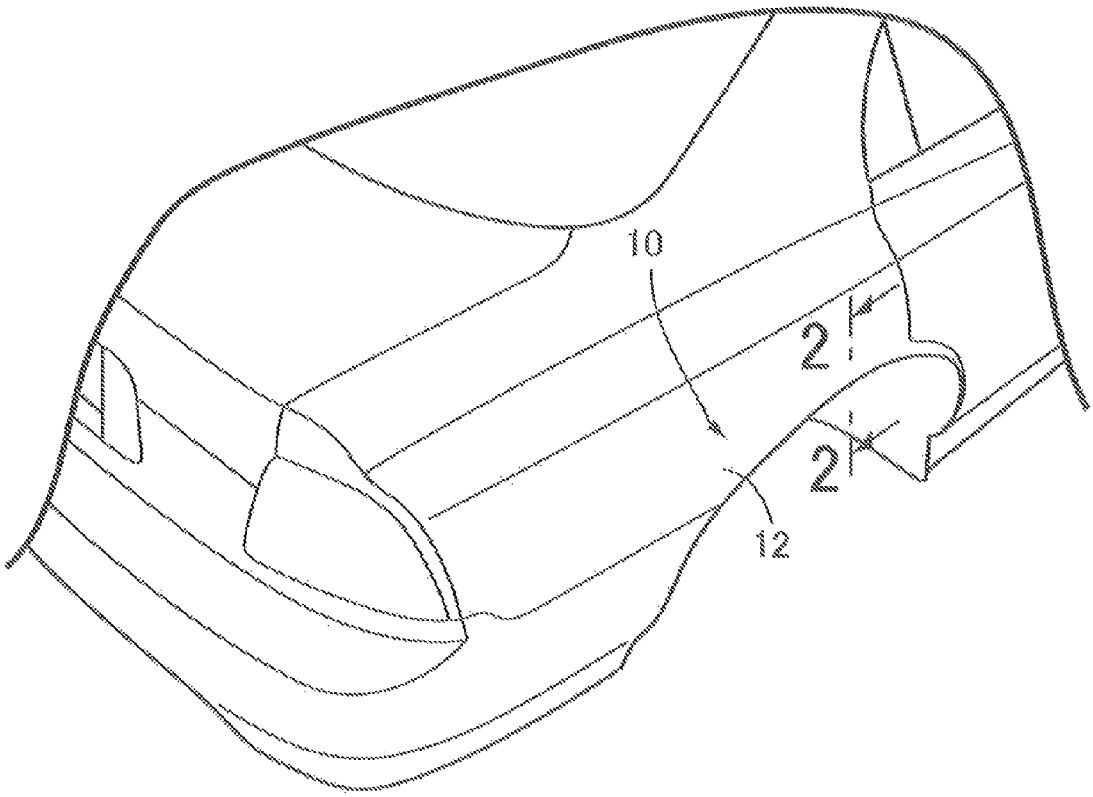
FIG. 1 is a perspective view of a rear fender portion of an automobile.
Figure 2:
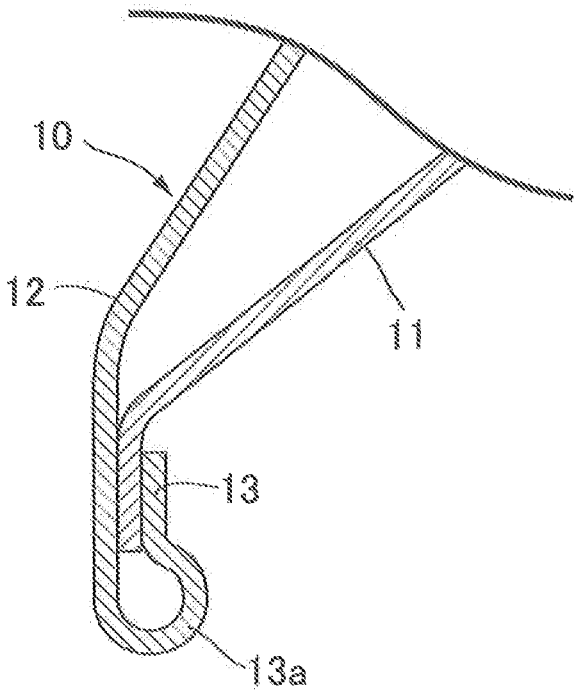
FIG. 2 is a sectional view taken along a 2-2 line in FIG. 1.

First, in FIG. 1 and FIG. 2, a rear wheel house unit 10 of an automobile includes a rear wheel house panel 11 and a rear fender panel 12 disposed on an outside of the rear wheel house panel 11. An end edge portion of the rear fender panel 12 is folded inward of a vehicle body in an arch portion of the rear wheel house unit 10, and an end edge portion of the rear wheel house panel 11 is clamped and held between the folded portion 13 and a body of the rear fender panel 12. Here, a tubular bead portion 13*a* is formed in a flexed part of the folded portion 13, whereby an end edge of the arch portion is smoothened.

Next, a process to be conducted in an automobile repair shop for joining a new rear fender panel 12, which is to replace an old part, to the rear wheel house panel 11 will be described with reference to FIGS. 3A to 3C.

Figure 3C:
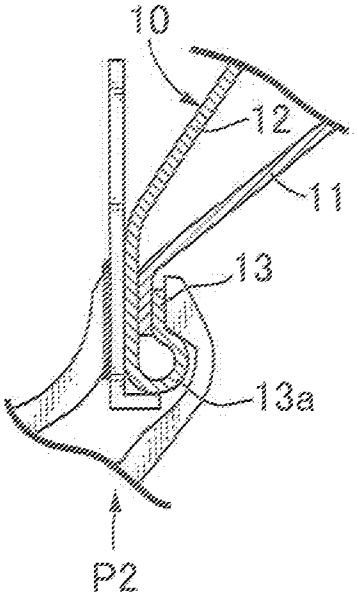
FIGS. 3A to 3C are views for explaining a repairing process of a rear fender panel.
Figure 3B:
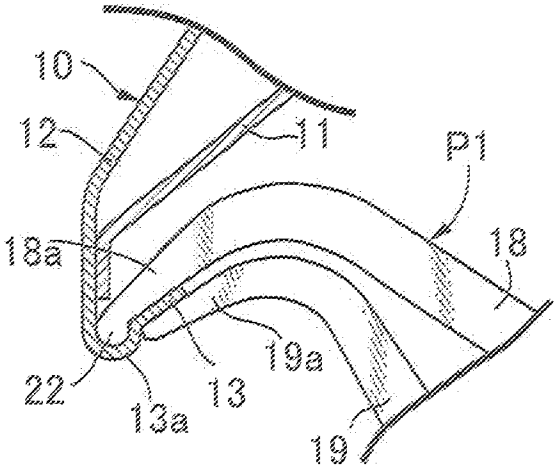
Figure 3A:
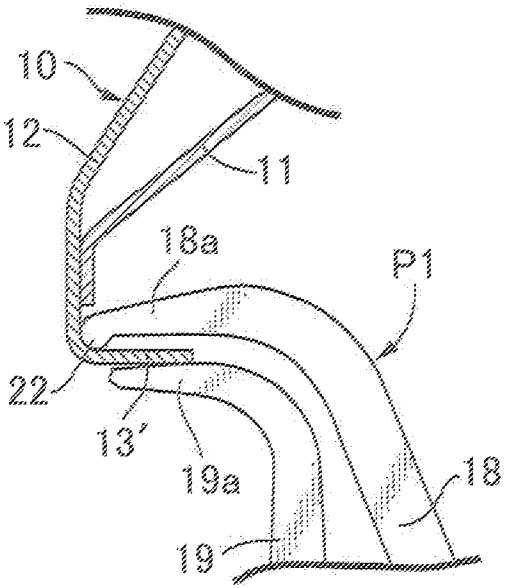
Figure 4:
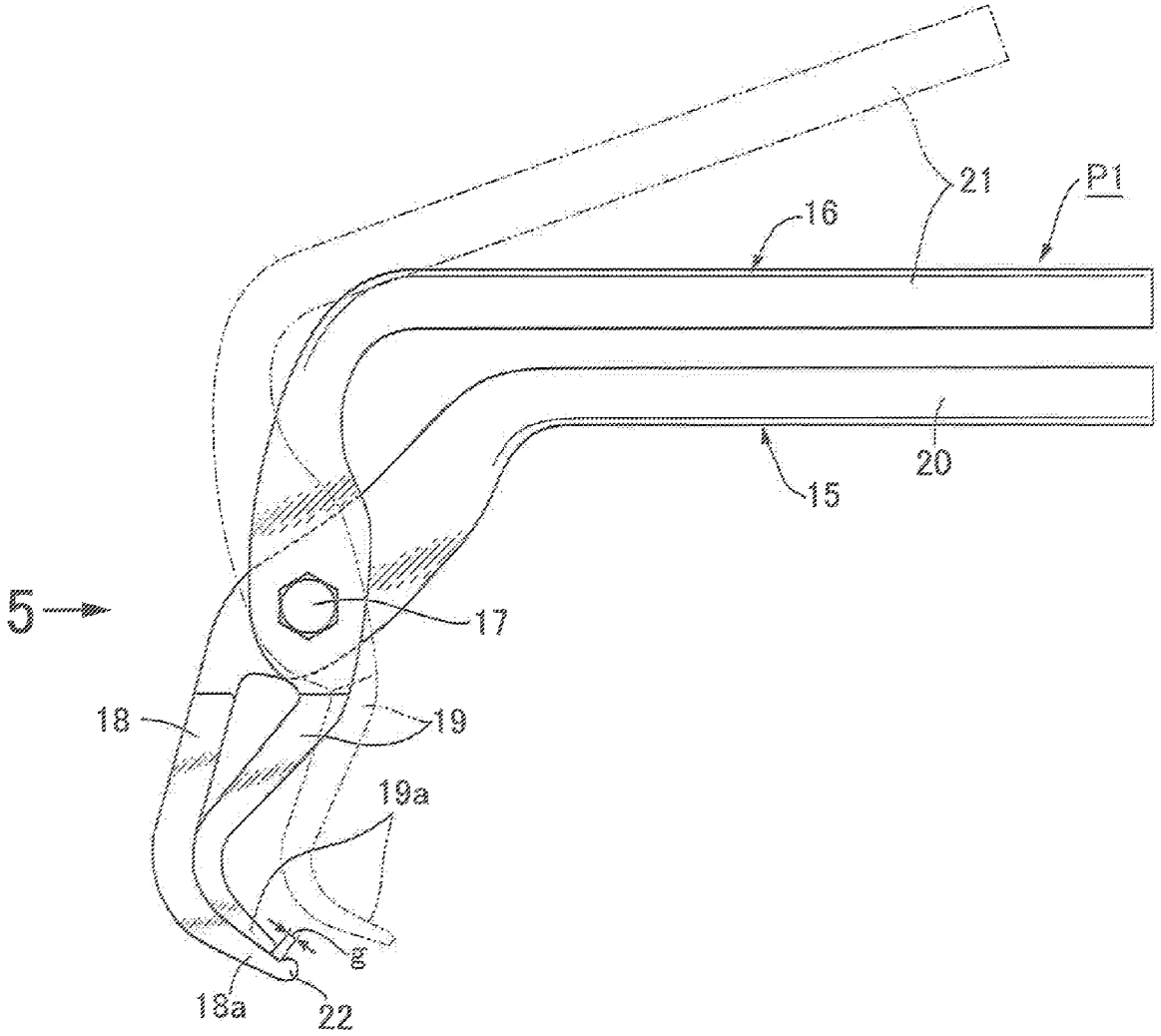
FIG. 4 is a side view of bending pliers according to the present invention.
Figure 5:
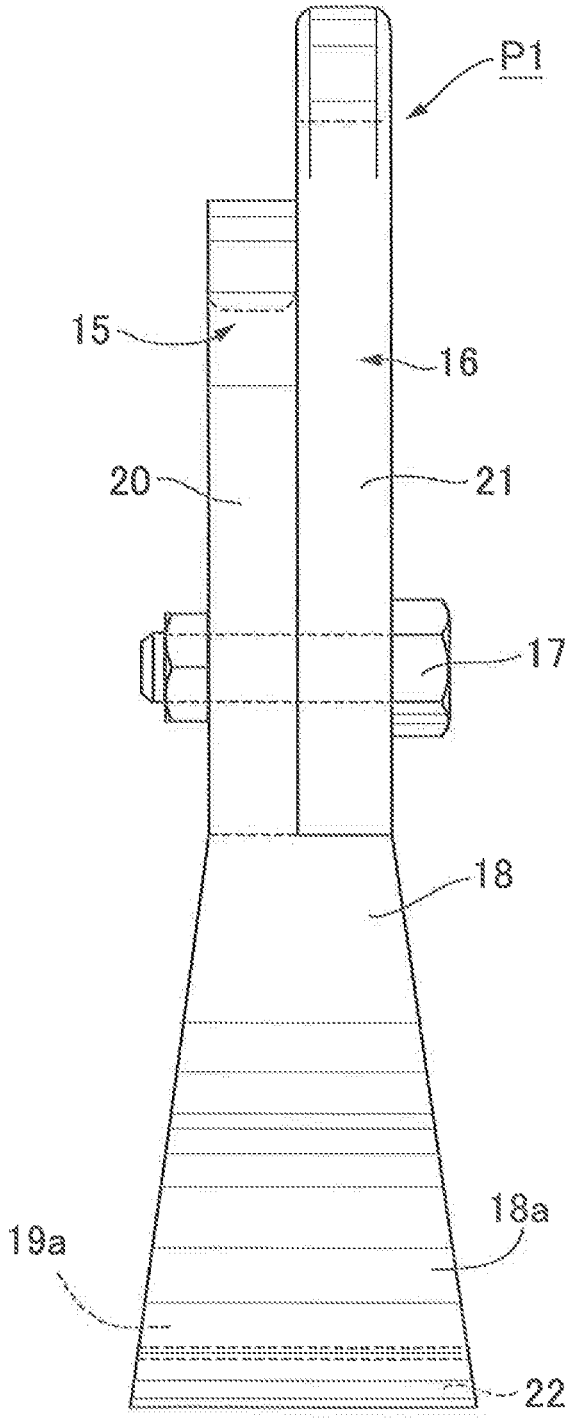
FIG. 5 is a view as seen in a direction of an arrow 5 in FIG. 4.
Figure 6:
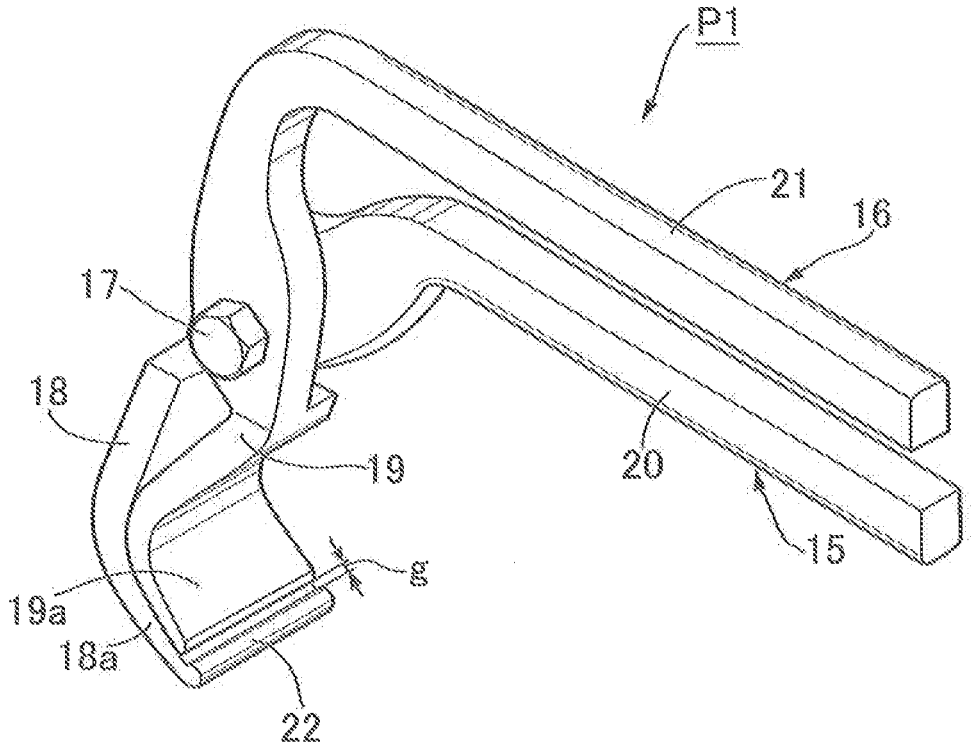
FIG. 6 is a perspective view of the bending pliers.

As shown in FIG. 3A, a to-be-folded portion 13', which is flexed at substantially 90° inward of the vehicle body from the body of the rear fender panel 12, is formed in the arch portion of the rear fender panel 12 before being joined. The folded portion 13 is formed by strongly clamping the to-be-folded portion 13' with bending pliers P1 of the present invention so as to form the tubular bead portion 13*a* and bend the to-be-folded portion 13' toward the rear wheel house panel 11 as shown in FIG. 3B. Next, the folded portion 13 and the body of the rear fender panel 12 are strongly clamped by use of hemming finishing pliers P2 while holding the rear wheel house panel 11 therebetween. Thus, the rear fender panel 12 is joined to the rear wheel house panel 11. Here, in order to strengthen joining between the rear fender panel 12 and the rear wheel house panel 11, it is preferable to coat bonding surfaces thereof with an adhesive. Meanwhile, in order to seal joined portions, it is preferable to coat a periphery of an end edge of the folded portion 13 with a sealing agent.

Next, the hemming pliers P1 as an embodiment of the bending pliers of the present invention will be described.

Constituents of the hemming pliers P1 include first and second plier bodies 15, 16, which are connected together to be turnable relative to each other in mutually intersecting intermediate portions thereof by use of a pivot shaft 17. Meanwhile, one end sides of the first and second plier bodies 15, 16 constitute first and second holding arms 18, 19, respectively, while the other end sides thereof constitute respectively first and second handles 20, 21 for opening and closing the first and second holding arms 18, 19.

Plate-shaped first and second claw portions 18*a*, 19*a* configured to cooperate to hold the to-be-folded portion 13' are formed in tip end portions of the first and second holding arms 18, 19, respectively. In addition, a columnar bending fulcrum portion 22 extending parallel to the pivot shaft 17 and projecting toward the second claw portion 19*a* is formed at a tip end of the first claw portion 18*a*. As shown the columnar bending fulcrum portion 22 is substantially cylindrical in shape. A tip end of the second claw portion 19*a* is opposed to the bending fulcrum portion 22 with a gap g therebetween. The gap g is set substantially equal to a plate thickness of the rear fender panel 12.

Each of the first and second holding arms 18, 19 is formed in a shape which becomes wider toward its tip end. In addition, the first and second holding arms 18, 19 are formed by bending in vicinities of roots of the first and second claw portions 18*a*, 19*a*, respectively, while locating the second holding arm 19 inside. On the other hand, the first and second handles 20, 21 are formed by bending in intermediate portions thereof close to the pivot shaft 17 while locating the first handle 20 inside.

Next, operation of this embodiment will be described.

To use the hemming pliers P1, first as shown in FIG. 3A, the first and second handles 20, 21 are gripped tightly to close the first and second handles 18, 19 while bringing the bending fulcrum portion 22 of the first claw portion 18*a* into contact with an inner corner of a flexed part of the to-be-folded portion 13' of the rear fender panel 12 and bringing the second claw portion 19*a* into contact with an outer side surface of the to-be-folded portion 13'. Thus, the to-be-folded portion 13' is clamped by the first and second claw portions 18*a*, 19*a*, whereby the to-be-folded portion 13' is clamped in a close contact state between the first and second claw portions 18*a* and 19*a* while being shaped in conformity to an outer peripheral surface of the bending fulcrum portion 22. Thus, the to-be-folded portion 13' is provided with the bead portion 13*a* shaped along the bending fulcrum portion 22 (see FIG. 3B).

Subsequently, in such a clamped state of the to-be-folded portion 13', the first and second handles 20, 21 are turned inward of the rear wheel house unit 10 around the bending fulcrum portion 22. Hence, as shown in FIG. 3B, the to-be-folded portion 13' is formed into the folded portion 13, which is provided with the bead portion 13*a* and is directed obliquely upward. Here, the bead portion 13*a* remains supported by the bending fulcrum portion 22, so that the bead portion 13*a* can maintain the given tubular shape. In addition, there is no possibility that the bead portion 13*a* is scratched by the second claw portion 19*a* since the second claw portion 19*a* never comes into contact with the outer peripheral surface of the bead portion 13*a*.

Here, it is also possible to manipulate the bending pliers P1 in such a manner as to form the folded portion 13 first and then to form the bead portion 13*a*, or in such a manner to form these portions at the same time.

The above-described bending work, i.e., hemming work is performed on an entirety of the arch portion of the rear wheel house unit 10.

In the meantime, since each of the first and second holding arms 18, 19 is formed in a shape which becomes wider toward its tip end, it is possible to perform the hemming work efficiently on a wide area in the to-be-folded portion 13'.

In addition, the first and second holding arms 18, 19 are formed by bending in the vicinities of the roots of the first and second claw portions 18*a*, 19*a*, respectively, while locating the second holding arm 19 inside. Meanwhile, the first and second handles 20, 21 are formed by bending in the intermediate portions thereof close to the pivot shaft 17 while locating the first handle 20 inside. Accordingly, the first and second handles 20, 21 are located outside the vehicle body at the outset of clamping the to-be-folded portion 13' with the first and second claw portions 18*a*, 19*a*. As a consequence, when the first and second handles 20, 21 are turned in order to form the folded portion 13, the folded portion 13 can be formed without turning the first and second handles 20, 21 into the vehicle body so deep that they would interfere with underbody parts of the vehicle.

Thereafter, as shown in FIG. 3C, in the entirety of the arch portion of the rear fender panel 12, the folded portion 13 is closely attached to an inner side surface of the rear wheel house panel 11 by using the hemming finishing pliers P2. Thus, the joining of the rear fender panel 12 to the rear wheel house panel 11 is completed.

Note that the present invention is not limited only to the above-described embodiment but various design changes are possible within a range not departing from the gist of the invention. The bending pliers of the present invention are applicable to a case of performing bending such as hemming and the like on various panels other than panels constituting a vehicle body of an automobile. The bending pliers are also applicable to a case of hemming a flat-plate end edge portion of a panel without the to-be-folded portion 13' as the one described in the embodiment.

What is claimed is:

1. Bending pliers comprising:

first and second plier bodies connected together to be turnable relative to each other in mutually intersecting intermediate portions thereof by, use of a pivot shaft, the first and second plier bodies including first and second holding arms formed on one-end sides of the first and second per bodies, respectively, the first and second holding arms respectively having first and second claw portions formed in their respective tip end portions and configured to hold therebetween a panel which is to be bent, the first and second holding arms including respective bent portions bent in a common bending direction with the bent portion of the second holding arm disposed inside of the bent portion of the first holding arm relative to the common bending direction of the bent portions, and first and second handles formed on opposite-end sides of the first and second plier bodes, respectively, and configured to open and close the first and second holding arms, wherein the tip end portion of the first claw portion has a cylindrical columnar bending fulcrum portion extending parallel to the pivot shaft, said cylindrical columnar bending fulcrum portion having a semicircular surface projecting radially outward toward the second claw portion, and wherein the bending pliers are configured such that when the second claw portion is brought into contact with the first claw portion without the panel therebetween a gap is defined between the tip end portion of the second claw portion and the bending fulcrum portion of the first claw portion, the gap extending along a common direction of the first and second claw portions.

2. The bending pliers according to claim 1, wherein the first and second handles also include respective bent portions bent in another common bending direction with the bent portion of the first handle disposed inside of the bent portion of the second handle relative to the common bending direction of the bent portions of the first and second handles.

3. The bending pliers according to claim 2, wherein the claw portion of the second holding arm is closer to the bent portion of the first handle than to the bent portion of the second handle.

4. The bending pliers according to claim 1, wherein the gap has a width which is equal to a plate thickness of the panel which the claw portions are configured to hold therebetween.

5. The bending pliers according to claim 1, wherein when an edge portion of the panel is held between the first and second claw portions with the first claw portion disposed above the second claw portion, the claw portions are squeezed shut, and the claw portions are rotated with the panel edge portion toward a remaining portion of the panel, the panel edge portion is bent around the columnar bending fulcrum portion to form a substantially tubular bead portion in the panel edge portion, and the second claw portion does not come into contact with the substantially tubular bead portion.

6. The bending pliers according to claim 1, wherein the first and second claw portions have a greater width than that of the first and second handles in a direction extending parallel to the pivot shaft.

* * * * *